US005118054A

United States Patent [19]

Kirschenbaum et al.

[11] Patent Number: 5,118,054

[45] Date of Patent: Jun. 2, 1992

[54] FLYING BAG TOY

[76] Inventors: Eileen Kirschenbaum; Marie Matsko, both of 27269 Grand Ave., Saugus, Calif. 91350

[21] Appl. No.: 672,162

[22] Filed: Mar. 19, 1991

[51] Int. Cl.[5] ..... B64C 31/06

[52] U.S. Cl. ..... 244/153 R; 73/188; 446/34; D21/88

[58] Field of Search ..... 244/153 R, 155 R; D21/88, 89; 446/34; 73/188, 189

[56] References Cited

U.S. PATENT DOCUMENTS

| | | | |
|---|---|---|---|
| 2,941,765 | 6/1960 | Feldman | 244/153 R |
| 3,860,204 | 1/1975 | Checkley | 244/153 R |
| 4,813,637 | 3/1989 | Bondestam | 244/153 R |

OTHER PUBLICATIONS

Noakes, M. L., Pub Abstract of G.B. 1593849, dated Jul. 1981.

*Primary Examiner*—Galen Barefoot

*Attorney, Agent, or Firm*—Roger A. Marrs

[57] ABSTRACT

A flying toy is disclosed herein in which a conventional plastic shopping bag is converted into a flying device for amusement purposes wherein the toy includes a lightweight bag having an inlet opening for receiving ram air and an exhaust or exit opening for discharging air. A plurality of small holes is distributed in the bag to avoid suffocation in the event a child should inadvertently become entangled. Tethering strings are employed for manual control of the inflated bag as the bag is pulled through the air and an adjustable closure is provided at the inlet to change the inlet size for efficient flight. For kit purposes, a string reel is provided as well as an attachable message sheet and an inlet adjustable ring.

1 Claim, 1 Drawing Sheet

FLYING BAG TOY

BACKGROUND OF THE INVENTION

1. Field of the Invention

The present invention relates to the field of amusement devices, and more particularly to a novel flying toy utilizing a conventional plastic shopping bag modified with an inlet and an exit so that ram air will maintain the bag airborne while a tethered string manually draws or pulls the bag through the air.

2. Brief Description of the Prior Art

In the past, it has been the conventional practice to provide a variety of flying toys which employ a body of material having openings for permitting ram air to pass through the body and whereby the exhaust provides a certain amount of thrust. Additionally, in some prior devices, such as disclosed in U.S. Pat. No. 2,941,765, an anchor line is provided for securing the flying toy to the ground for hands-off flight. However, no provision is made in such a device for manually pulling the flying toy through the air.

Further difficulties and problems have been encountered with such conventional devices which stem largely from the fact that the devices are specially made from predetermined patterns and do not form a conversion from existing products. Also, the particular shape of the flying device, whether it be a kite or toy airplane configuration, requires prior aerodynamic design and consideration in order to provide flight.

Therefore, a long-standing need has existed to provide a novel flying toy which can readily be modified from a conventional object such as a plastic shopping bag. Accessory items such as drawstrings, spools, inlet adjustment, message units and the like may be provided in a kit form which can subsequently be added to the basic shopping bag so that a useful and amusing flying toy can be assembled.

SUMMARY OF THE INVENTION

Accordingly, the above problems and difficulties are obviated by the present invention which provides a novel flying toy comprising a shopping bag type membrane which is modified with an exhaust opening so that ram air entering the forward scoop or inlet end of the membrane will pass along the longitudinal axis of the membrane for thrustable exhaust through the exit. The membrane is further provided with a plurality of very small holes or openings along the sides so as to prevent suffocation of a child should the child place the bag over his head during the course of play. Message areas are placed on the exterior sides of the membrane so as to carry a selected message that may be attached thereto by adhesive means or the like or may be carried thereon such as by painting, printing or the like. Preferably, the inlet or scoop end of the membrane is provided with an adjustable means for controlling the inlet area so that the efficiency of flight can readily be adjusted. A string or other means is provided by attachment to the handle portions of the membrane so that the device may be pulled through the air insuring that the ram air will create buoyancy for the membrane It is of critical note that the membrane be composed of a thin plastic or plastic-like material having a high strength-to-weight ratio so that the membrane is extremely light and of great strength so as to permit flight while resistant to tears, rips or cuts.

In another form of the invention, accessory items such as strings, reels and inlet adjustment means may be provided in a separate kit form so that the user may assemble the flying toy at his leisure after the membrane in the form of a shopping bag has been brought home from the shopping center.

Therefore, it is among the primary objects of the present invention to provide a novel flying toy which may be converted from a conventional shopping bag into an amusing device adaptable to be pulled through the air to sustain flight.

Another object of the present invention is to provide a novel flying toy composed of a plastic or plastic-like material of high strength-to-weight ratio having an inlet and an exit through which ram air is passed to sustain the device in flight and which further includes means for adjusting the inlet of the ram air to the device as well as providing a means for manually drawing or pulling the device through the air.

Yet another object of the present invention is to provide a novel flying toy which will provide amusement for the user and which is extremely inexpensive since the primary component of the device is a plastic shopping bag normally given away at shopping places.

A further object of the present invention resides in providing a flying toy which may be converted from an ordinary shopping bag so that the device is extremely inexpensive and one which is safe for a child to use as well as being uncomplicated to convert and to fly.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood with reference to the following description, taken in connection with the accompanying drawings in which:

DESCRIPTION OF THE PREFERRED EMBODIMENT

Figure 1:
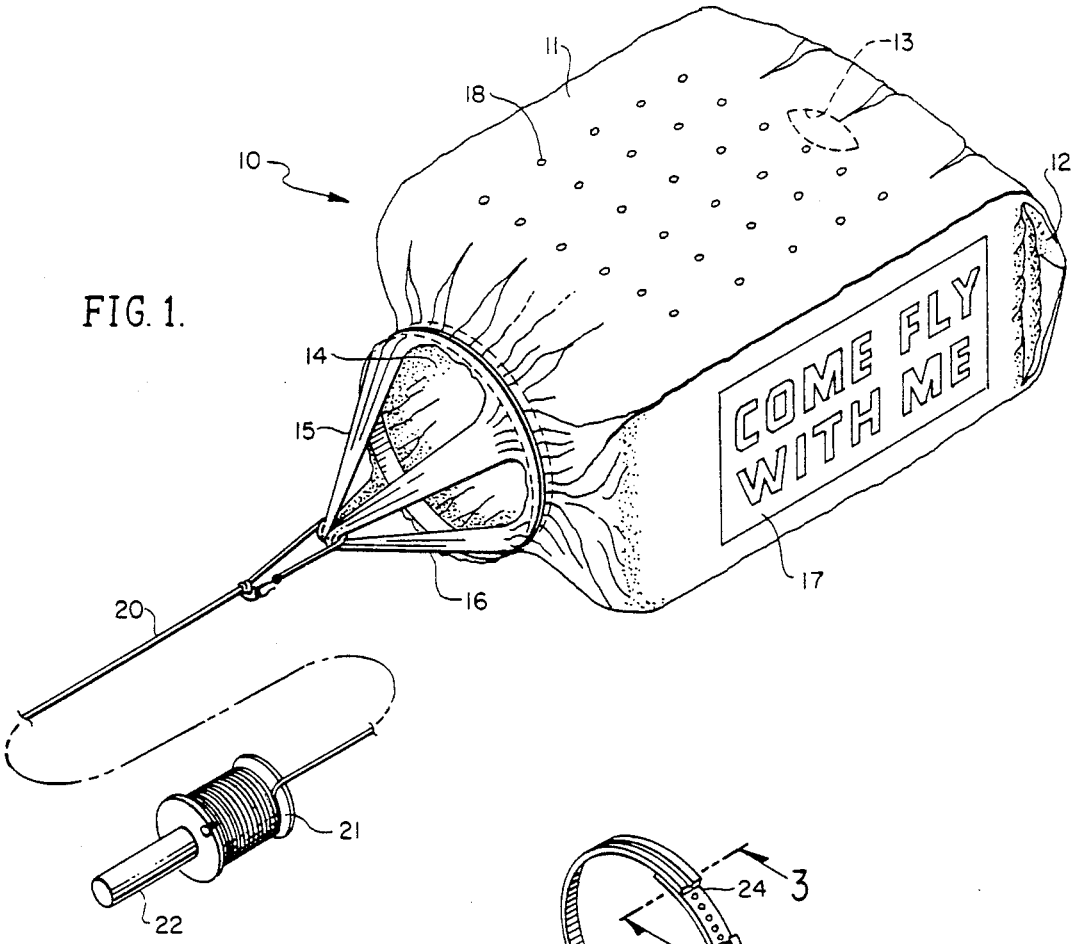
FIG. 1 is a front perspective view showing one version of the flying toy incorporating the present invention.

Relating to FIG. 1, the novel inventive flying toy is shown in one form in the general direction of arrow 10 which includes a thin and lightweight membrane formed in the general configuration of a bag 11. The bag may be formed in any conventional way with sides, a bottom or the like just as long as a bag-type enclosure is defined by a thin-walled membrane of high weight-to-strength ratio material. With respect to the bag 11, it is provided with a bottom 12 in which a hole or exhaust opening 13 is provided in opposition to the other end of the bag which includes a major opening 14. Inasmuch as the bag 11 is a conventionally manufactured bag of the shopping type, it includes handles 15 and 16 which are used by a shopper to carry the contents from the store to home. The exterior surface of the bag may be provided with an advertising or message area 17 for carrying a plurality of alpha/numeric indicia. However, it is to be understood that a message may be carried on a separate sheet and applied at a subsequent time by suitable adhesive or other attachment means.

In order to prevent injury to a child that may become entangled in the bag, a plurality of small holes, such as hole 18, are placed in rows and columns through the sidewall of the bag membrane so as to permit a small passage of air should the interior become pressurized. In this fashion, a child may breathe in the event his head is enclosed by the bag inadvertently.

The opening 14 constitutes an inlet through which ram air is introduced into the interior of the bag and the opening 13 serves as an exhaust for discharging the ram air. To maintain flight, the bag must be drawn through the air so that the ram air resides within the interior and only a small portion is exhausted. Such an exhaust may provide thrust for the bag while the air inside the bag will retain buoyancy for the device. A shroud or pull line 20 may be attached to the handles 15 and 16 so that the child may pull the bag in any desired direction. Therefore, it is to be understood that the flying bag is not anchored to the ground and should forward movement of the buoyant bag cease, the bag will slowly float to the ground. If desired, a reel 21 with a handle 22 may be employed for wrapping the string or cord 20 around the spool for better control of the device while flying. In this manner, the spool may let out more cord or may draw the cord into its storage position on the reel. Such a device is not necessary to the invention but may add to the combination in the event that the kit is employed for converting the ordinary shopping bag to a flying toy.

Figure 2:
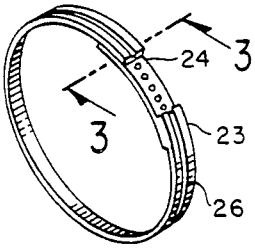
FIG. 2 is a perspective view showing an adjustable means adaptable for use with the membrane of the flying toy shown in FIG. 1 to achieve a variable inlet.
Figure 3:
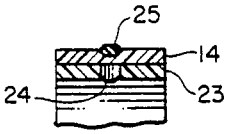
FIG. 3 is an enlarged transverse cross-sectional view of the adjustable means shown in FIG. 2 as taken in the direction of arrows 3—3 thereof.

In such a conversion kit, it may be desirable to adjust the inlet 14 to a desired diameter, and one means for doing so would be the use of a circular and adjustable band 23, such as shown in FIG. 2. The opposite ends of the band include a releasable attachment, such as a post and hole arrangement broadly indicated by numeral 24 so that the diameter of the band is adjustable. The band may be readily placed about the exterior wall of the inlet 14 and a rubberband, such as indicated by numeral 25 in FIGS. 3 and 4, may be placed within an external groove to retain the sidewall material of the inlet with respect to the band. FIG. 3 shows such a relationship when the band 23 is on the inside of the bag entrance 14 while the bag itself is indicated by numeral 14 and the rubberband 25 is on the outside forcing a portion of the bag sidewall into the groove, as indicated by numeral 26.

Figure 4:
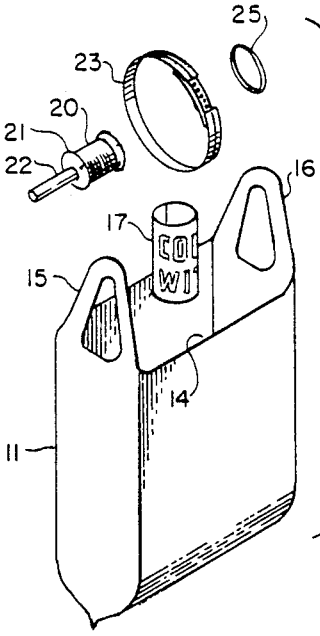
FIG. 4 is an exploded prospective view showing a conventional shopping bag convertible to a flying toy by use of accessories.

Referring in detail to FIG. 4, it can be seen that the present invention is assembled in a kit form wherein the shopping bag 11 is emptied and modified to include the hole or exhaust opening 13. The kit can also include a message carried on a separate sheet 17 which is placed anywhere on the external side of the bag for display purposes. Next, the rubberband 25 and the adjustable inlet ring 23 are included in the kit as well as the reel 21 carrying a length of drawstring material 20. In this fashion, the components of the assembly can be prepackaged into a plastic bag and sold separately from the shopping bag which is obtained by the user from the store.

It is of great importance that the sidewall material of the bag 11 be constructed of a high strength-to-weight material such as plastic, mylar or any other derivative of the plastic family, such as polychloride vinyl, urethane, polyester or the like. The shopping bag 11 provides a ready attachment for the string or pulling means 20 since the handles 15 and 16 are available for attachment and the mouth of the bag defines the inlet 14.

In view of the foregoing, it can be seen that the bag may be simply attached to a string and pulled through the air after the exhaust hole 13 and safety holes 18 have been punched in the bag. A more elaborate device is available to converting the bag into a flying toy using an accessory kit which may include the adjustable inlet means 23, the rubberband 25 and the spool 21. Other means may be provided for adjusting the inlet, such as providing the drawstring in the material itself that may be readily adjusted by the user after the bag has been used for shopping purposes.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. A flying toy comprising:

a bag-like structure having a thin wall, high strength-to-weight ratio material providing a membrane defining an enclosed internal compartment;

openings at opposite ends of said bag-like structure for conducting ram air through said membrane;

no more than a pair of semi-circular handle members integrally carried on one end of said bag-like structure adjacent a selected opening;

said selected opening constituting an inlet for the ram air;

tether means secured to said semi-circular handle members for pulling said bag-like structure through the air;

a plurality of small holes in said membrane releasing air under internal pressure on said membrane;

a spool with a string collecting reel;

said tether pulling means comprising a length of string attached to said handle members drawing said handle members together;

a band of variable diameter disposed in said selected inlet for varying the diameter of said selected inlet;

securement means on said inlet for securing said band in a selected position at said inlet; and said membrane having an exterior area carrying indicia.

* * * * *